US005628690A

United States Patent [19]

Spieldiener et al.

[11] Patent Number: 5,628,690

[45] Date of Patent: May 13, 1997

[54] AMUSEMENT RIDE WITH AT LEAST ONE LONGITUDINAL GUIDE WITH A PASSENGER VEHICLE CAPABLE OF CHANGES IN HEIGHT

[76] Inventors: Robert Spieldiener, J.-Rheinberger-Str. 18 / Principality of Liechtenstein, FL-9490 Vaduz; Reinhold Spieldiener, Aussichtsstrasse 23, CH-8704 Herrliberg; Patrick Spieldiener, Erlenstrasse 134, CH-8832 Wollerau; Alfons Saiko, Speerstrasse 26, CH-8942 Oberrieden, all of Switzerland

[21] Appl. No.: 518,550

[22] Filed: Aug. 23, 1995

[30] Foreign Application Priority Data

Sep. 8, 1994 [DE] Germany ..... 9414609 U

[51] Int. Cl.[6] ..... A63G 31/00

[52] U.S. Cl. ..... 472/131; 472/50

[58] Field of Search ..... 472/131, 135, 472/136, 49, 50; 482/77, 33; 434/30, 59

[56] References Cited

U.S. PATENT DOCUMENTS

| | | | |
|---|---|---|---|
| 2,221,215 | 11/1940 | Eyerly | 472/131 X |
| 3,701,528 | 10/1972 | Ryan | 472/131 |
| 4,580,982 | 4/1986 | Ruppert | 434/30 |
| 5,087,037 | 2/1992 | Morrow | 482/77 |

*Primary Examiner*—Kien T. Nguyen

*Attorney, Agent, or Firm*—Lowe, Price, LeBlanc & Becker

[57] ABSTRACT

An amusement ride according to the present invention includes a vertical tower having one or more sides. Along each side of the tower, passengers are strapped into separate vehicles which are lifted vertically to the top of the tower, from where the vehicles are released. The vehicles free fall until slowed and stopped by a braking system. Vertical guides attached to the tower control the direction of the vehicles.

25 Claims, 3 Drawing Sheets

AMUSEMENT RIDE WITH AT LEAST ONE LONGITUDINAL GUIDE WITH A PASSENGER VEHICLE CAPABLE OF CHANGES IN HEIGHT

BACKGROUND OF THE INVENTION

1. Field of the Invention

This invention relates generally to an amusement ride. More particularly, the invention relates to an amusement ride having at least one passenger carriage which is lifted vertically to the top of a tower from where it is released, dropping the carriage in free fall until it is brought to rest by a braking system.

2. Description of the Related Art

Conventional amusement park rides include passenger-carrying vehicles attached to rails or tracks built onto one or more supporting structures. Some of these tracks include steep inclines which may result in the passengers feeling that they are descending in an unbraked manner. The inclines may also provide the passengers with a brief sensation of weightlessness.

In so-called looping amusement park rides, such as that disclosed in U.S. Pat. No. 4,165,695 (Schwarzkopf), the ride includes an incline which transports the passenger vehicle almost vertically up a portion of a track. When the vehicle runs out of kinetic energy, it stops momentarily before continuing backwards through a loop. Passengers riding on the near-vertical portion of the track briefly feel that they are "free falling" in an unbraked manner.

The vertical tracks disclosed in the prior art must be attached to large, often expensive, support structures. In addition, the prior art looping rides, roller coasters, and the like normally require a great deal of space in order to operate. These requirements result in an increase in the cost of manufacturing amusement rides that are intended to allow passengers to free fall.

In U.S. Pat. No. 2,221,215 (Eyerly), there is disclosed a vertical column to which there is attached one or more passenger seats. The seats in the '215 patent are raised and lowered along the tower by means of a rubber band or spring. Such a ride presents a number of disadvantages. Moreover, because the elasticity of the rubber band or spring degrades over time, the useful life of the ride is quite limited. Furthermore, because the elastic means may break unexpectedly, the ride poses a great threat to passenger safety.

OBJECTS OF THE INVENTION

It is an object of this invention is to provide an amusement ride capable of quickly changing the elevation of a passenger vehicle without requiring an inclined track on which to support the ride.

It is another object of the present invention to provide an amusement ride which allows passengers to free fall for a short duration.

Another object of the invention is to provide a safe yet exciting amusement park ride experience, while minimizing the space requirements and costs of constructing the ride.

Additional objects, advantages, and novel features of the present invention will be set forth in part in the description which follows, and in part will become readily apparent to those skilled in the art from the following detailed description, wherein the preferred embodiments of the invention are shown and described simply by way of illustration of the best mode contemplated for carrying out the invention. The objects and advantages of the invention may be realized and attained by means of instrumentalities and combinations particularly pointed out in the appended claims.

SUMMARY OF THE INVENTION

According to the present invention, the foregoing objectives and other objects and advantages are attained by an amusement ride comprising a vertical tower with one or more vehicles attached to the tower. Initially, each vehicle is set stationary at a starting point located near the bottom of the tower, adjacent to a passenger loading platform. After one or more passengers are loaded onto the vehicle, the vehicle is raised vertically by lifting means to a point near the top of the tower, where it is released. The vehicle then free falls until it reaches a braking section, where it is gradually slowed and eventually stopped. Both in the upward and downward direction, the vehicle is directed by vertical guide means attached to the tower.

There are numerous variations and examples shown of the present invention. For example, the lifting means may comprise one or more drive drums attached to a point near the top of the tower. A wire cable or chain hoist is wound about the drive drum in a number of turns. One end of the cable or hoist attaches to a counter weight, while the other end of the cable or hoist is permanently attached to a yoke that is connected to the top of the passenger vehicle.

The means for releasing the vehicle from the lifting means further comprises a hook, which is rigidly attached to the yoke. The hook is connected to a spring that also attaches to the yoke. The force of the spring causes the hook to slip through and grip a roller means attached to the passenger vehicle. When the vehicle reaches its peak elevation, the hook is released from the roller means by a detachment mechanism. The detachment mechanism may be activated in a number of different ways, such as by electromagnetic means, pneumatic means, hydraulic means, or mechanical activator means.

When the hook is released, the passenger vehicle in turn is released from the yoke and free falls. The yoke then returns to the bottom of the tower by electrical means, where it reattaches to the passenger vehicle.

A special problem is posed by the need to brake the full kinetic energy created in the drop in such a manner as not to endanger the passengers. To achieve this end, the invention is designed to have groups of brakes fixed one above the other with progressive efficiency, in order to incrementally slow the vehicle.

The inventive ride may be erected using different variations to the design of the tower. For example, a circular tower, or multi-sided tower may be utilized. In the multi-sided tower, separate passenger vehicles may be attached to each side of the tower. Each vehicle is lifted by separate hoisting means. In addition, the individual vehicles may carry one or more passengers. For example, assuming that the tower has four sides, and that each side has a separate passenger vehicle carrying up to four passengers, the amusement ride may be able to carry up to sixteen passengers simultaneously. A wide range of different-capacity passenger cars, and different-shaped towers, may be utilized without departing from the spirit or scope of this invention.

DETAILED DESCRIPTION OF THE INVENTION

Figure 1:
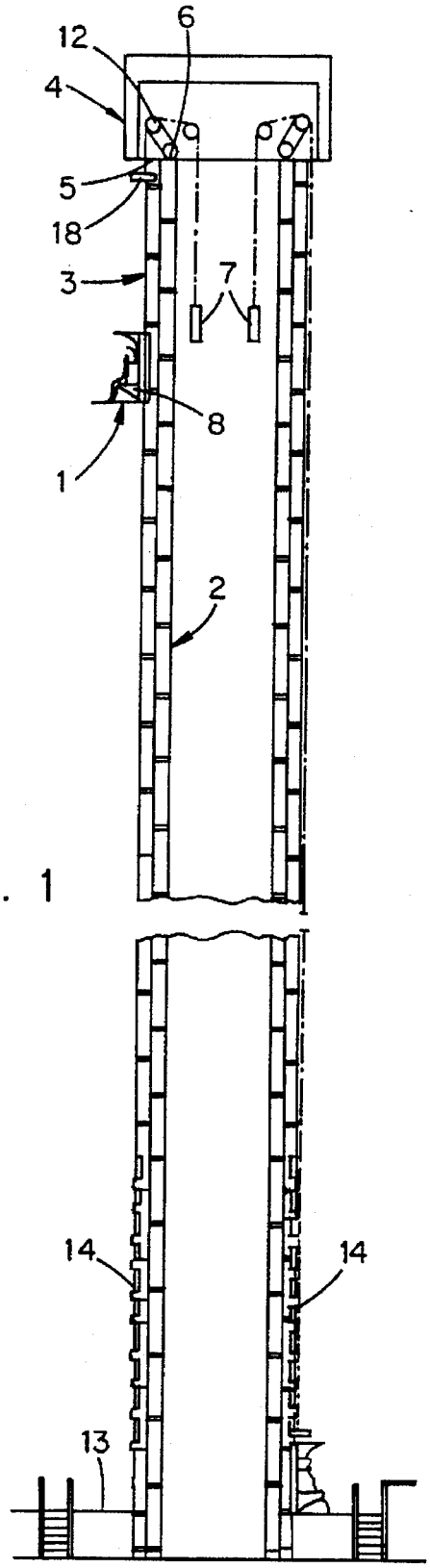
FIG. 1—a side view of a tower fitted with the amusement ride of the present invention together with the passenger vehicle attached thereto.

The amusement device shown in FIG. 1 comprises a vertical tower 2. Adjacent to a lower end of tower 2 is a platform 13, from which passengers enter and exit one or more passenger vehicles 1. Each passenger vehicle 1 is vertically guided along the length of tower 2 by guide means 3 attached to an outside surface of tower 2. Vehicle 1 is raised by lifting means 4 from an initial elevation until the vehicle reaches a final elevation, near the top of tower 2. When it reaches the final elevation, vehicle 1 is released from lifting means 4, free falling until it is slowed, and eventually stopped, by brake means 14.

Figure 3:
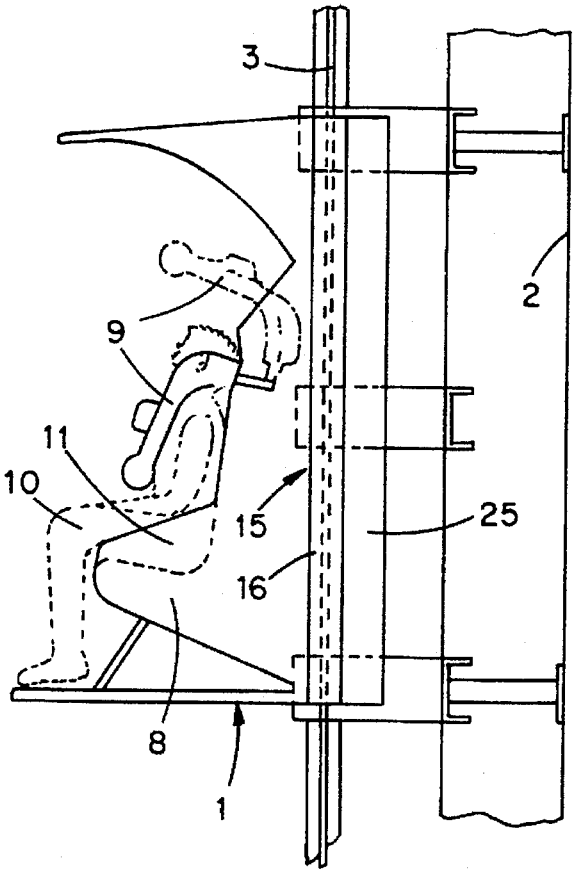
FIG. 3—a side view of a passenger vehicle with a passenger in enlarged view.

As indicated in FIG. 3, passenger vehicle i comprises one or more seats 8 for one or more passengers 10. Each of the seats 8 comprises shoulder restraints 9, which are pulled down over the shoulders of the passengers 10 to hold them securely in their respective seats 8. In addition, seats 8 comprise side protectors 11 fitted on either side of seats 8 so that individual passengers 10 cannot come out sideways from their seated position. Preferably the legs of the passengers will not be supported and will hang freely. If, however, footrests are required or desired, such footrests may be placed in such a position so as not to cause or result in any shocks to the passengers' feet during the braking of vehicle 1.

In FIG. 1, it is further shown schematically that lifting means 4 comprises a wire cable or chain hoist 5, and a gear drive system 6 secured to the top of tower 2. The wire cable or chain hoist 5 is drawn through a number of windings around drive drum 12. One end of the cable or hoist 5 is attached to the vehicle, as more particularly described below, while the other end of cable or hoist 5 is attached to a counter-weight 7. As will be shown later, in the preferred embodiment of the present invention, vehicle 1 is lifted until it reaches its final elevation, at which point it is detached from lifting means 4.

Also placed near the lower end of tower 2, beginning at a point between the initial and final elevations, is brake means 14. The function of brake means 14 is to slow the free fall of vehicle 1, and to stop vehicle 1 when it reaches the initial elevation. Such incremental braking avoids the heavy braking loads on passenger 10 that would otherwise be caused by more rapid braking.

Figure 6:
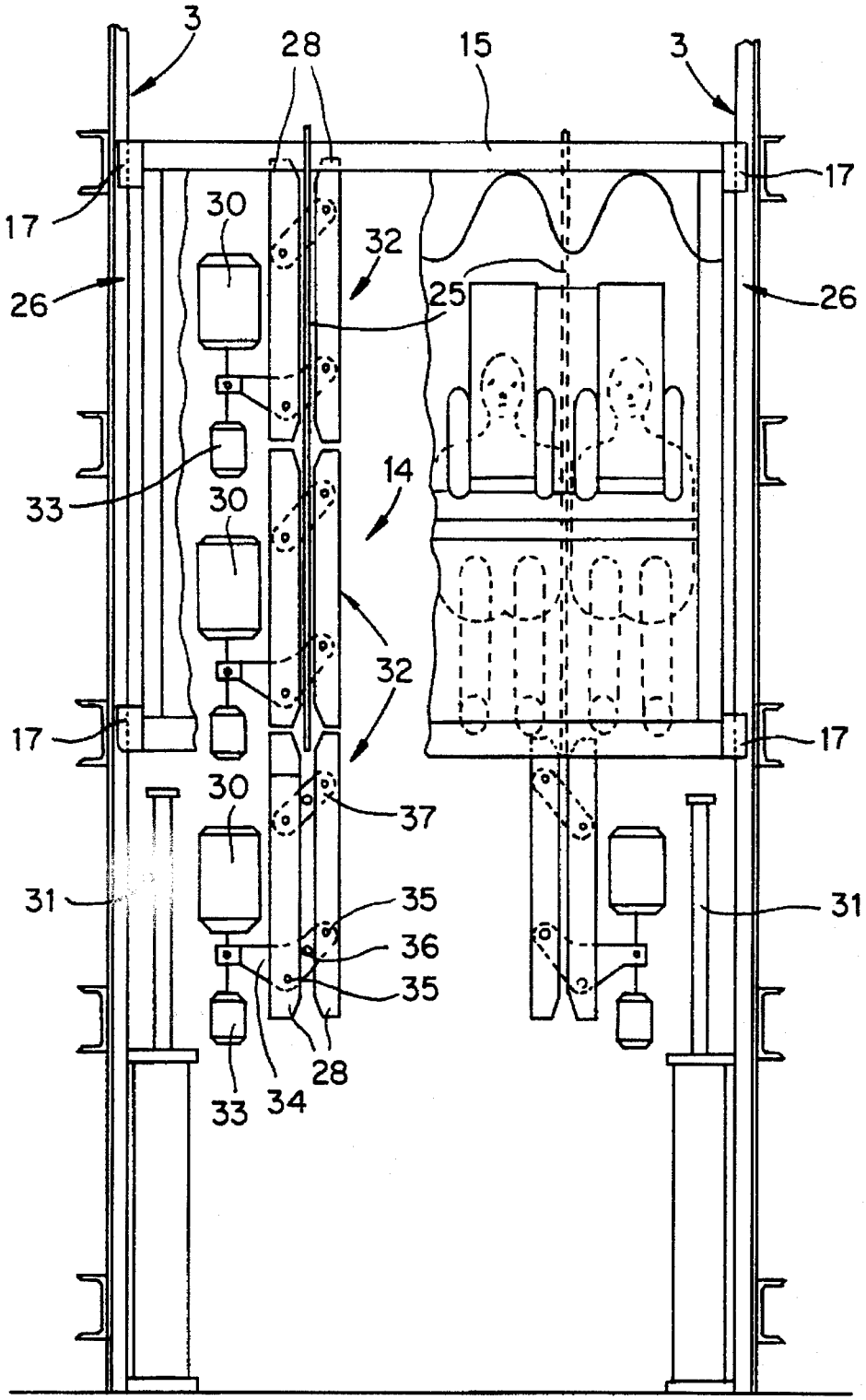
FIG. 6—a front view of one half of a passenger vehicle in the brake system, together with a front view of the multiple brake groups.

As can be seen from the example shown in FIG. 6, brake means 14 comprises a plurality of steps of brakes 32 located vertically within the braking section. The individual steps of brakes 32 may each have approximately the same strength of braking. However, it is preferred that each brake 32 has a different strength of braking than the other brakes. Thus, for example, brakes 32 may be arranged in the braking section such that a first brake step 32, which the free falling vehicle 1 encounters first, provides a relatively light brake action, and that the brake action of the next brake is incrementally heavier than the first brake. Similarly, each brake step 32 through which falling vehicle 1 passes imparts a heavier braking force than the preceding brake step 32.

Figure 4:
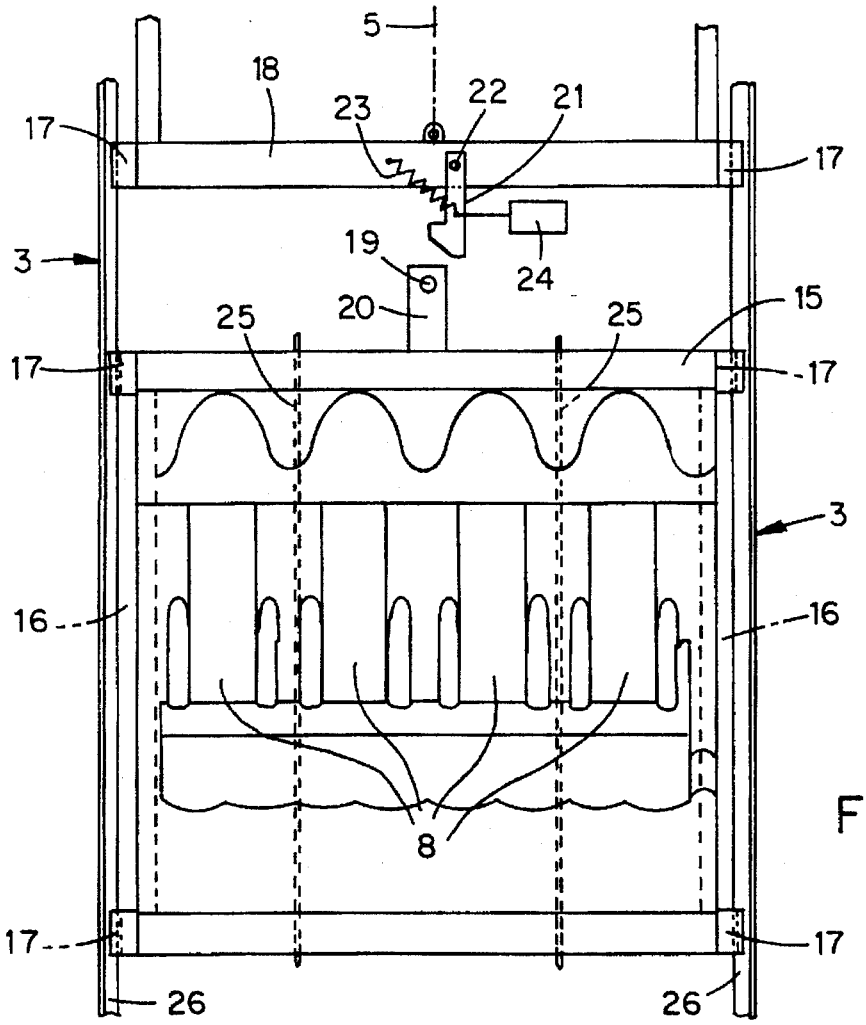
FIG. 4—a front view of a passenger vehicle with support.
Figure 5:
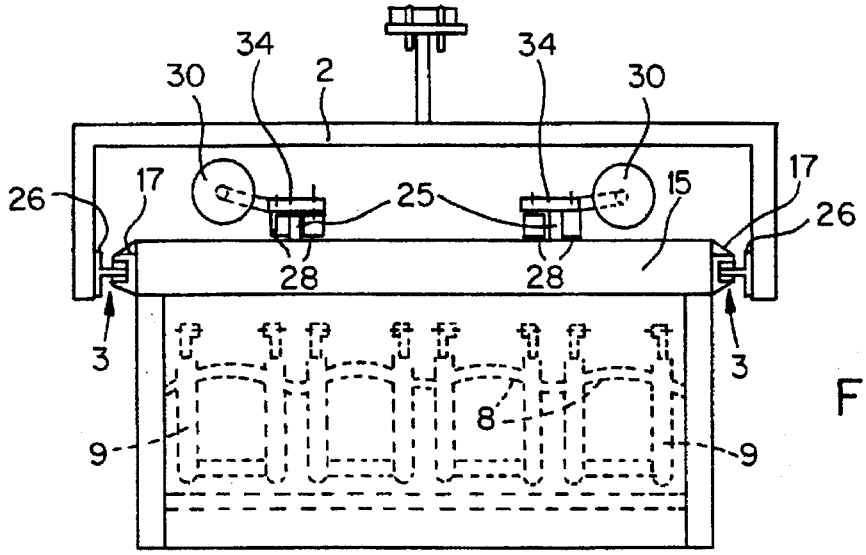
FIG. 5—a top view of a passenger vehicle showing its guides and brakes.

From the example shown in FIGS. 3 through 5, it can be seen that passenger vehicle 1 further comprises a pair of opposing horizontal frames 15, and a pair of opposing vertical frames 16 placed between, and connected to, the horizontal frames 15. Attached to each end of frames 16 are friction guide elements 17 which correspond with guide elements 26 of vertical guide means 3. Friction guide element 17 and guide elements 26 can be set in any order. For example, friction guide elements 17 and guide elements 26 could comprise wheel guides. However, in the example, friction guide rails are shown.

In the preferred embodiment, guide elements 26 are formed in the shape of a Tee, and are attached vertically to tower 2. Guide elements 26 fit into corresponding vertical channels in friction guide elements 17. In this manner, guide elements 17 interconnect with respective guide elements 26. Thus, when seat 8 with passengers 10 are on the vertical guide 3, there is no reduction in the free fall action of the passenger vehicle 1 since friction guide elements 17 are attached to the top and the bottom of vertical frame 16.

In order to ensure the proper lifting of passenger vehicle 1, and further, to ensure that vehicle 1 will be released when it reaches the final elevation, the detachment means comprises a yoke 18 placed in a horizontal direction and located above frame 15. As stated above, yoke 18 is permanently attached to wire cable or chain hoist 5. Yoke 18 also directs guide elements 17 and 26 in a vertical direction along the tower by way of vertical guide 3.

Yoke 18 comprises a hook 21 on a vertical gravity line around an axle 22. One end of spring 23 is connected to yoke 18, while the other end of spring 23 abuts hook 21. In this manner, spring 23 imparts a force on hook 21. In addition, roller 19 is attached to a fixed point 20 on top of passenger vehicle 1. When yoke 18 descends, hook 21 meets a bearing surface of roller 19. Spring 23 forces hook 21 to slip through and grip under roller 19, thereby attaching yoke 18 to passenger vehicle 1. Once yoke 18 is attached to vehicle 1, lifting means 4 lifts both yoke 18 and passenger vehicle 1.

The attachment of yoke 18 to vehicle 1 is not permanent. Indeed, as soon as passenger vehicle 1 reaches its final elevation, vehicle 1 is released from lifting means 4. To cause the releasing, an electromagnet 24 or similar means is provided. The activation of electromagnet 24 causes hook 21 to detach from roller 19, thereby causing passenger vehicle 1 to free fall, guided only by tower guide rails 3. After the release, yoke 18 returns to the bottom of tower 2 along guide rails 3 by means of an electrical system. When it reaches the bottom of tower 2, yoke 18 reattaches to passenger vehicle 1 in the manner described above.

As further shown in FIG. 5, brake means 14 comprises at least two brake fins 25 on the side of frame 15 of vehicle 1 nearest tower 2. Brake means 14 also comprises pairs of opposed brake pads 28 attached to tower 1. Brake fins 25 protrude in a direction parallel to vertical guides 3, and are positioned so that each brake fin 25 passes through a corresponding pair of brake pads 28 when passenger vehicle passes through the braking section. The friction created by brake fins 25 passing through brake pads 28 creates a braking action that slows and eventually stops vehicle 1.

Brake pads 28 as shown in FIG. 6 are in an "active" position; that is, each brake pad 28 is pressed against its opposed brake pad 28 by brake power system 30. Brake power system 30 imparts a force to brake pads 28 sufficient to narrow the gap between the individually-opposed brake pads 28, so that the width of the gap between the brake pads is smaller than the width of brake fin 25.

Brake power system 30 can be empowered by means of a standard truck pneumatic brake system. In the unlikely event that the brake power system would fail, braking means 14 may further comprise a built-in spring system, which activates a continual brake power in addition to the pneumatic power.

Brake means 14 further comprises release mechanism 33 for releasing brake pads 28 from brake fin 25. Both brake power system 30 and brake release mechanism 33 react with a first lever 34 connected to the brake pads 28 and the frame 36. A second lever 37 is also provided, for ensuring the parallel movement of brake pads 28. Brake power system 30, first lever 34, and second lever 37 are shown symbolically in FIG. 6.

When free falling passenger vehicle 1 reaches the brake section, the brake power system 30 causes brake pads 28 to close in on brake fin 25, ensuring that a braking action takes place. Braking means 14 comprises a plurality of braking steps 32, vertically located one above the other throughout the braking section. Each step 32 may be set with a different braking strength. In this way, a gentle braking of the free falling passenger vehicle 1 is possible.

Within the design of the present invention, it is possible to have certain areas with no brakes or less efficient brakes so that a special ride experience is possible, in which one or more of the brake steps is released, causing the passenger vehicle to accelerate downward again before being stopped at the initial elevation.

One way of creating this alternative braking system is to connect brake power system 30 to the last brake step 32 in the braking section. Brake power system 30 causes brake pads 28 to be opened for a very short period of time, thus releasing vehicle 1, and allowing it to free fall again. A hydraulic shock absorbing buffer 31 is fitted underneath the last brake step 32, to absorb the shock of passenger vehicle 1. This shock absorber 31 is designed and built such that the passenger vehicle 1 is brought safely to the initial elevation, adjacent to platform 13.

The present invention is not limited to this type of braking system. Indeed, other braking systems may be used without departing from the spirit or scope of this invention, such as eddy current motors or similar devices. In the event that such other braking mechanisms are provided, then no brake fins or brake pads would be necessary. Moreover, the design of the present invention allows for the installation of hydraulic dampers at the bottom to ensure that the vehicle really is in the final position.

Figure 2:
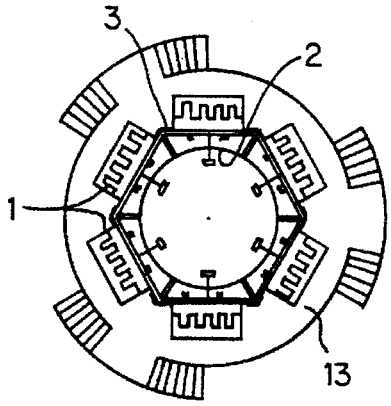
FIG. 2—a cross-section of the tower for an amusement ride.

In the example shown in FIG. 2, the tower 2 comprises six sides. In this embodiment, it would be possible to have on the outside of the tower 2 six passenger vehicles 1, each of which is separately guided on the vertical guides 3 in a vertical direction. Each passenger vehicle 1 may have a different passenger capacity. For example, in the illustration, each of the vehicles 1 has a capacity of four passengers. Thus, the ride has a total capacity of 24 passengers who can ride at the same time. Moreover, by varying the timing of the individual hoist means 4, each vehicle 1 can simultaneously be in a state of lifting or falling that is different from the other vehicles.

FIG. 2 also shows but one variation on the shape of the tower. It is possible, for example, to make tower 2 either 3-sided, 4-sided, 6-sided, 8-sided, or circular. Regardless of the number of sides utilized, it is important that the outside of the tower 2 have vertical protruding guide means 3 on which the passenger vehicle 1 can be lifted and dropped.

The guide means 3 of the present invention may also be attached to the side of a building or wall, and could be used for transporting goods instead of passengers. For example, the vehicle can be used to take goods from a lower elevation to a higher elevation, where the goods may be removed therefrom. The vehicles then free fall, returning empty to the bottom. Thus, the present invention is not necessarily restricted to amusement ride use only, but may also be utilized for commercial or manufacturing functions. Such other functions and uses are considered to be within the scope of the present invention.

In sum, the amusement ride described above allows for a rapid change in the elevation of a passenger vehicle without the need for an inclined track on which to support the ride. Passengers of the inventive ride may experience a brief sensation of weightlessness, followed by several moments of free fall, all in a safe, controlled environment. Moreover, because the ride comprises a vertical tower, the space requirements and cost of building the inventive ride should be much less than the space requirements and cost for building a conventional loop, roller coaster, or similar amusement ride.

It should be understood by those skilled in the art that the present invention is capable of other and different embodiments, and its several details are capable of modifications in various obvious respects, all without departing from the scope of the invention. Accordingly, the above drawings and descriptions should be regarded as illustrative in nature only, and not as restrictive. Modifications in materials, shapes, or other details are deemed to be within the scope of the appended claims.

What I claim is:

1. An amusement ride, comprising:

a generally vertically extending support structure;

at least one vehicle movably supported on the structure for carrying one or more passengers from an initial lower elevation to a final higher elevation;

a lifting arrangement operatively associated with said support structure for elevating said at least one vehicle to the final elevation;

a guide arrangement projecting from an outside surface of the support structure for generally vertically guiding the vehicle along said outside surface;

detachment mechanism operatively mounted for disconnecting the vehicle from the lifting arrangement when the vehicle reaches the final elevation, said vehicle falling freely until it reaches a predetermined elevation; and a braking means including a braking section, located at said predetermined elevation, for applying a braking force in s direction perpendicular to the free fall direction for reducing the speed of the vehicle.

2. An amusement ride as claimed in claim 1, wherein the support structure includes a vertical tower and wherein the vehicle comprises:

a pair of horizontal opposed frames;

a pair of vertical opposed frames, placed between and connected to the pair of horizontal opposed frames;

a plurality of passenger seats attached to the horizontal and vertical pairs of frames;

friction guide means attached to the pair of vertical opposed frames and vertically aligned with the guide arrangement, for directing the vehicle in a vertical direction between the initial and final elevations.

3. An amusement ride as claimed in claim 2, wherein the passenger seats further comprise:

shoulder restraint means for securing a passenger to the seat; and side restraint means for preventing the seated passenger from moving laterally.

4. An amusement ride as claimed in claim 3, wherein each passenger seat further comprises foot support means.

5. An amusement ride as claimed in claim 2, wherein the friction guide means and guide arrangement comprise wheel guides.

6. An amusement ride as claimed in claim 2, wherein the guide arrangement comprises a straight section, and a section perpendicular to the straight section to form a Tee, and the friction guide means comprises a cavity which secures and vertically guides the T-shaped section of the guide arrangement.

7. An amusement ride as claimed in claim 1, wherein the support structure includes a vertical tower and wherein the lifting arrangement comprises:

a drive drum near the top of the tower;

gear drive means for rotating the drive drum; and cable means wound about the drive drum in a plurality of turns, for raising and lowering the vehicle in response to the rotation of the drive drum, wherein a first end of the cable means attaches to the vehicle, and a second end of the cable means attaches to a counterweight.

8. An amusement ride as claimed in claim 7, wherein the cable means comprises a wire cable.

9. An amusement ride as claimed in claim 7, wherein the cable means comprises a chain hoist.

10. An amusement ride as claimed in claim 1, wherein the detachment mechanism comprises:

a yoke connected to the lifting arrangement and placed above the vehicle, the yoke being guided vertically by the guide arrangement;

hook means connected to the yoke;

spring means for imparting a force on the hook means; and roller means attached to the top of the vehicle and capable of attaching to the hook means, wherein the force of the spring means causes the hook means to connect to the roller means when the yoke is a predetermined distance from the vehicle.

11. An amusement ride as claimed in claim 10, wherein the hook means comprises a vertical hook connected to the yoke by an axle, and the spring means comprises a spring attached to the yoke on one end of the spring and abutting the hook on the opposite end of the spring.

12. An amusement ride as claimed in claim 10, wherein the detachment mechanism causes the hook means to disconnect from the roller means when the vehicle reaches the final elevation.

13. An amusement ride as claimed in claim 12, wherein the detachment mechanism comprises electromagnetic means.

14. An amusement ride as claimed in claim 12, wherein the detachment mechanism comprises at least one of pneumatic, hydraulic, and mechanical activator means.

15. An amusement ride as claimed in claim 1, wherein the support structure is a tower and the braking means comprises a plurality of braking steps, each step located vertically above the next within the braking section, the braking steps each comprising:

a plurality of brake fins protruding from a side of the vehicle nearest the tower, parallel to the guide arrangement;

a plurality of opposing pairs of brake pads attached vertically to the tower and aligned with the brake fins, each pad separated from its opposed pad by a distance sufficient to allow a respective brake fin to pass therethrough when the vehicle reaches the braking section; and brake power means for pressing the pairs of opposed brake pads together a distance narrower than the width of the brake fins.

16. An amusement ride as claimed in claim 15, wherein the braking step located closest to the top of the tower imposes the least braking force on the vehicle means, and each subsequent braking step imposes a braking force greater than that imposed by the preceding braking step.

17. An amusement ride as claimed in claim 15, wherein the braking means further comprises:

means for opening the brake pads of the lowest brake step, closest to the initial elevation; and shock absorption means fitted against the vehicle for absorbing a shock imposed when the lowest brake pad releases the vehicle.

18. An amusement ride as claimed in claim 1, wherein the support structure is a vertical tower having a plurality of sides, and each side has associated therewith a separate one each of said vehicle, lifting arrangement, guide arrangement, detachment mechanism, and braking arrangement.

19. An amusement ride as claimed in claim 18, wherein the vertical tower comprises one of three sides, four sides, six sides, and eight sides.

20. An amusement ride as claimed in claim 18, wherein the vertical tower is circular.

21. A vertical transporter, comprising:

a substantially vertically extending support structure;

at least one vehicle movably supported on the structure for carrying cargo from an initial lower elevation to a final elevation;

a lifting arrangement operatively associated with said support structure for elevating said at least one vehicle to the final elevation;

a guide arrangement attached to an outside surface of the support structure for vertically guiding the vehicle along said outside surface;

a detachment mechanism operatively mounted for disconnecting the vehicle from the lifting arrangement when the vehicle reaches the final elevation, said vehicle falling freely until it reaches a predetermined elevation; and a braking means including a braking section for applying a braking force in a direction perpendicular to the free fall direction for reducing the speed of the vehicle.

22. The amusement ride of claim 1, wherein said braking means is fixedly mounted within the support structure and incapable of movement in the direction of free fall.

23. An amusement ride, comprising:

a generally vertically extending support structure;

at least one vehicle movably supported on the structure for carrying passengers from an initial lower elevation to a final elevation;

a lifting arrangement operatively associated with said support structure for elevating said at least one vehicle to the final elevation;

a guide arrangement projecting from an outside surface of the support structure for generally vertically guiding the vehicle along said outside surface;

a detachment mechanism operatively mounted for disconnecting the vehicle from the lifting arrangement when the vehicle reaches the final elevation, said vehicle falling freely until it reaches a predetermined elevation; and a braking means for operatively interacting with the vehicle only after the vehicle reaches said predetermined elevation.

24. An amusement ride, comprising:

a substantially vertically extending support structure:

at least one vehicle movably supported on the structure for carrying cargo from an initial lower elevation to a final elevation;

a lifting arrangement operatively associated with said support structure for elevating said at least one vehicle to the final elevation;

a guide arrangement attached to an outside surface of the support structure for vertically guiding the vehicle along said outside surface;

a detachment mechanism operatively mounted for disconnecting the vehicle from the lifting arrangement when the vehicle reaches the final elevation, said vehicle falling freely until it reaches a predetermined elevation; and a braking arrangement formed separate and apart from the lifting arrangement to reduce the vehicle speed and stop the vehicle during free fall.

25. An amusement ride, comprising:

a vertical tower;

vehicle means for carrying one or more passengers from an initial elevation near the base of the tower to a final elevation above the initial elevation;

platform means adjacent to the base of the tower for regulating the flow of passengers to and from the vehicle means;

lifting means for elevating the vehicle means from the initial elevation to the final elevation;

detachment means for disconnecting the vehicle means from the lifting means when the vehicle means reaches the final elevation, wherein the vehicle means falls freely until it reaches a braking section located between the initial and final elevations;

tower guide means attached to an outside surface of the tower for vertically guiding the vehicle means between the initial and final elevations; and a braking means including a braking section for applying a braking force in a direction perpendicular to the free fall direction for reducing the speed of the vehicle means and ultimately stopping said vehicle means.

* * * * *